US005642599A

United States Patent [19]

Tisma

[11] Patent Number: 5,642,599

[45] Date of Patent: Jul. 1, 1997

[54] AUTOMATIC PACKAGING MACHINE FOR BOXES WITH PAPER END LINERS

[75] Inventor: Stevan Tisma, Elk Grove Village, Ill.

[73] Assignee: Tisma Machinery Corporation, Elk Grove Village, Ill.

[21] Appl. No.: 622,255

[22] Filed: Mar. 26, 1996

Related U.S. Application Data

[63] Continuation of Ser. No. 337,771, Nov. 14, 1994.

[51] Int. Cl.[6] ..... B65B 7/00

[52] U.S. Cl. ..... 53/373.6; 53/373.7; 53/375.2

[58] Field of Search ..... 53/170, 373.6, 53/373.7, 374.8, 375.2, 570

[56] References Cited

U.S. PATENT DOCUMENTS

| | | | |
|---|---|---|---|
| 2,114,624 | 4/1938 | Bergstein | 53/373.6 |
| 2,415,978 | 2/1947 | Vergobbi | 53/373.6 |
| 2,979,995 | 4/1961 | Bergstein et al. | 53/373.6 |
| 3,089,298 | 5/1963 | Neuandorf et al. | 53/373.6 |
| 3,451,194 | 6/1969 | Nerenberg et al. | 53/373.6 |
| 3,559,372 | 2/1971 | Cerioni | 53/373.6 |
| 4,306,400 | 12/1981 | Coleman et al. | 53/373.6 |

*Primary Examiner*—James F. Coan
*Assistant Examiner*—Gene L. Kim
*Attorney, Agent, or Firm*—Laff, Whitesel, Conte & Saret, Ltd.

[57] ABSTRACT

An automatic packaging system closes and seals a hybrid box having end flaps with a narrow paper strip sealed to and around an inside perimeter of the box. A projecting edge of the narrow strip extends out of the box approximately as far as the outer edges of the end flaps. First, the end flaps are folded away from the narrow paper strip. A pair of spreading fingers move in synchronism with boxes while they are being carried by a conveyor. The spreading fingers are moved toward the boxes and inserted into a "bag" opening formed by narrow strip. The spreading fingers move apart for closing the projecting edges of the narrow strip and bringing the sides of the strip into face-to-face confrontation. There the sides are gripped and stretched to prevent puckers or pleats. While the projecting edges are so gripped in a face-to-face confrontation, they are sealed in order to close the "bag" opening formed by the paper strip.

11 Claims, 8 Drawing Sheets

AUTOMATIC PACKAGING MACHINE FOR BOXES WITH PAPER END LINERS

This application is a continuation of application Ser. No. 08/337,771, filed Nov. 14, 1994 abandoned.

This invention relates to automatic packaging machines and more particularly to such machines for sealing boxes having end paper liners.

Most automatic packaging machines are designed to pick up folded boxes, which are then opened, filled with products, and thereafter closed and sealed. If nothing more than a box is used, moisture or insects may penetrate to contaminate the product; or, particulate matter forming the product may sift from the box. When a product must be further protected to avoid these and similar problems, it is common to put the product into a sealed bag and then to put that bag into the box. Hence, two packaging machines are required, one to bag and one to box. An example of this packaging arrangement is a bag of potato chips or cereal packed inside a cardboard box.

This use of both a bag and a box raises more packaging problems since the bag is usually semi-flattened, perhaps with a somewhat oval cross section. Then, this bag has to be shaped into a somewhat square or rectangular cross section so that it will fit into the box. From the technical view, this shaping can be done; however, it imposes a further cost upon the packaging machine.

Therefore, recent developments have led to a hybrid box wherein a relatively narrow strip of paper end liner is sealed to the inside perimeter of the box. Then, only one packaging means is required to dump the product into the box and then seal the paper end liner in essentially the same manner that the end of the bag of potato chips or cereal is sealed. This hybrid of box and bag is as secure from invasion of contaminants and sifting of product from the box as the separate bag and box. The hybrid box also solves the problem of putting a bag having an oval cross section into a rectangular box without damage to the crushable content of the bag. Since the bag is not present, the box may hold approximately 15% more product which reduces the over all size of the box for the same product bulk, thereby saving shipping and storage costs.

However, the box with a paper end liner requires a sequence of steps which is somewhat new and foreign to conventional automatic packing machines. Therefore, existing packaging machines for the hybrid box have heretofore been stop/start machines which required a sequence of discreet steps where the flow of packages is interrupted between each of the discreet steps. This has reduced the automatic packaging speed to about a third of the normal packaging machine speed. That reduction in speed makes it difficult for the packaging machine for hybrid boxes to work in concert with other packaging machines.

A further problem is that some of the newer automatic packaging machines are built with a modular concept where standardized modular box formers, loaders, scales, etc. are put together in many different ways in order to provided unique packaging without requiring the designing of a new machine for each new type of product. Thus, if the machine for sealing boxes having paper end liners is a start/stop type of device, it cannot be used as a modular add-on to other standardized modules which are designed to operate continuously.

Accordingly, an object of this invention is to provide an automatic packaging machine for sealing paper end liners in hybrid boxes with a continuous flow of packages. Here an object is to provide new and novel packages which eliminate the need to put bags having a somewhat oval cross section, and filled with crushable products into a box having a rectangular cross section.

Another object is to provide a free standing, standardized module which may be added to other free standing, standardized modules in order to make a customized packaging machine.

In keeping with an aspect of the invention, these and other objects are accomplished by providing means for first pulling out, shaping, and stretching the hybrid box with paper end liner. Then, the hybrid box is conveyed between parallel plows which fold out the end flaps. Next, the paper end liner moves between heating elements which heat seal the paper end liner in the manner that a bag is sealed. Finally, the sealed end liner or "bag" is folded and the end flaps of the box are brought together and sealed over the folded liner or "bag".

A preferred embodiment of the invention is shown in the attached drawings in which.

Figure 1:
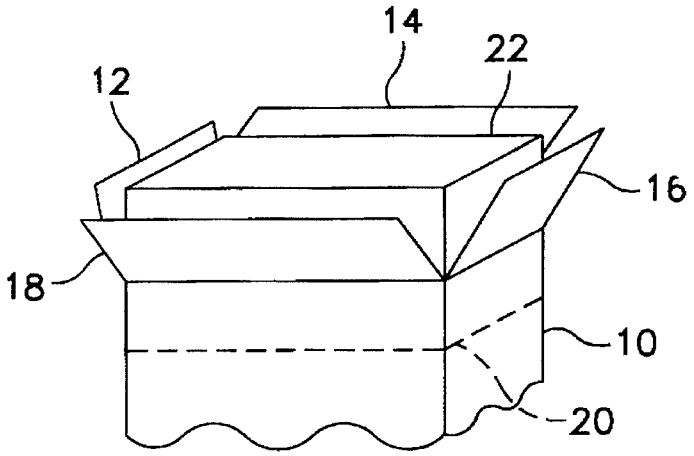
FIG. 1 is a perspective view which shows an end of a box containing a paper end liner, it being understood that the opposite end of the box is constructed in the same manner.

In FIG. 1, a cardboard box 10 (perhaps a cereal box) has four end flaps 12, 14, 16, 18 which are upstanding when the box 10 is first erected. A relatively narrow paper strip 20 is cemented to and sealed around the entire inside perimeter of the box, near the top (or bottom), so that the upper edge 22 of the paper strip is approximately aligned with the upper edges of the end flaps.

The paper strip may be essentially the same material that is used to make the bag for containing the cereal, potato chips, or the like. The surface next to the food is a paper which conforms to regulations for paper touching food products. Next to that paper is an integral layer 15 formed of a heat sealing adhesive. Beyond this, any other suitable material may be added and laminated to the paper, such as a metallized film, a printed layer or the like. All of these or other layers are herein included within the term "paper".

The bottom of the box, not shown, is constructed in a manner which is the same as that shown in FIGS. 1–4.

The end flaps 12–18 of the box are lowered to expose the "bag". The "bag" top 22 is then spread (FIG. 2) to bring the two sides of the "bag" together in a face-to-face confrontation. Next, heat is applied along a stripe 24 and the heated paper is rolled to seal the "bag". At this time, the appearance of the "bag" is somewhat similar to the appearance of a sealed bag of cereal in a box.

Since the generally rectangular "bag" of FIG. 1 has been spread in order to bring the sides together to close the opening, ends 26, 28 of the sealed "bag" project beyond the side walls 30, 32 of the box.

To enclose the "bag" within the box (FIG. 3), the top edge 22 of the "bag" is folded over and then the ends 26, 28 are folded in.

Finally (FIG. 4), the end flaps 12–18 of the box are folded over to completely enclose the "bag". Heat is applied to the folded end flaps to heat seal the box in a closed condition.

At this time, the product is as protected as it would be if a conventional full bag, sealed on both ends, is enclosed within a box. More particularly, the tube forming the box is completely sealed except at the opposite ends. The paper strip 20 is sealed to the box around the entire interior perimeter thereof. The upper edge of the paper strip is sealed at 24. Hence, there is not only a complete barrier to an invasion of moisture and vermin, but also a protection against product sifting out of the box. Moreover, since almost 100% of the interior of the box is filled with product, with no waste space left between a full and complete bag and interior box walls, the total package size is reduced by about 15%.

Figure 5:
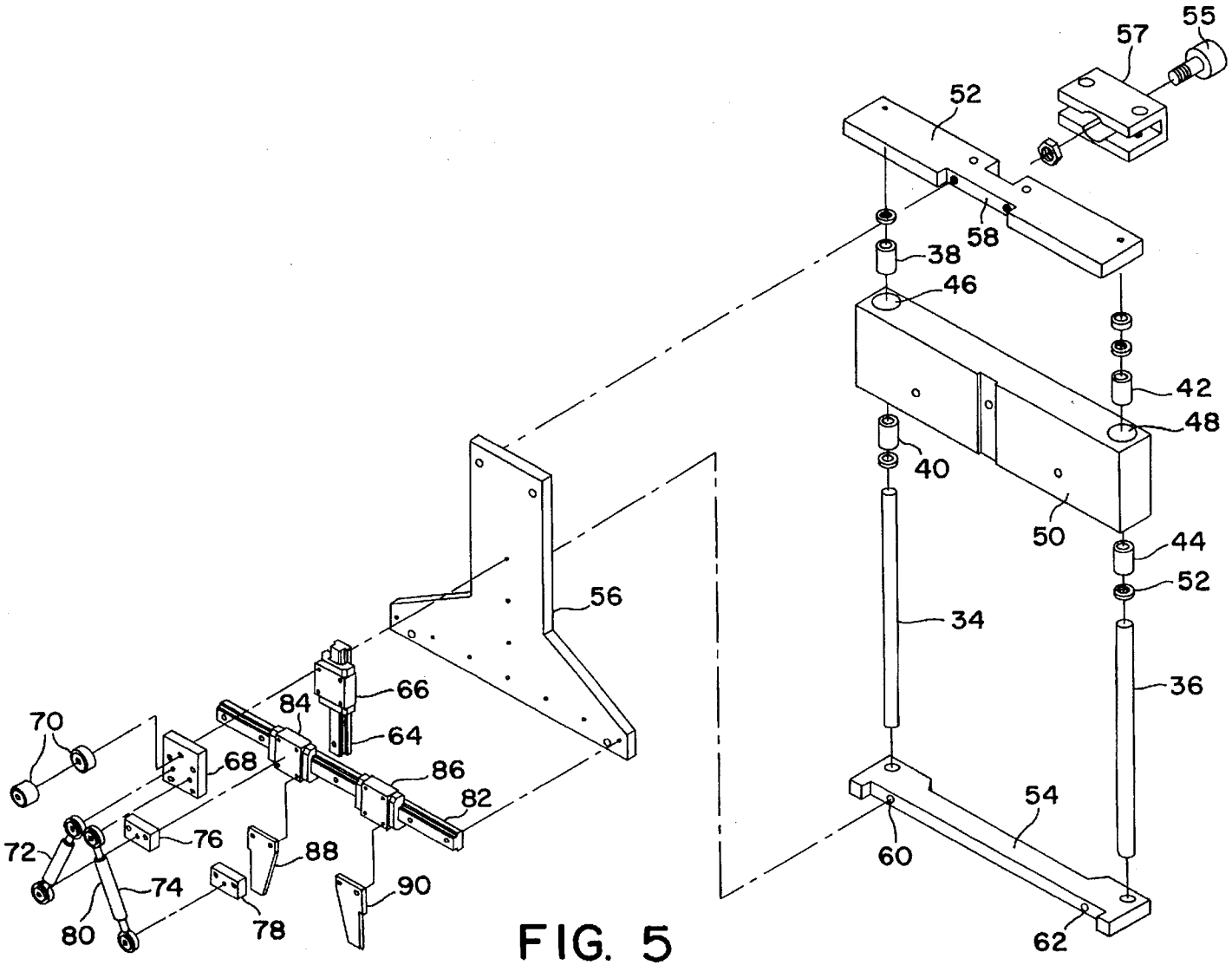
FIG. 5 is an exploded view of a spreader assembly used to close the "bag" formed by the paper end liner.

The mechanism for spreading the paper end liner is seen in FIG. 5. More particularly, a vertical displacement means is a frame, having two side rails 34, 36, secured to mounting plate 50 which in turn is attached to a link chain conveyor (not shown in FIG. 5). Four sliding bearings 38–44 are mounted in holes 46, 48 on mounting bar 50. The holes are sealed by rings, such as 52, on the opposite ends thereof. The upper and lower ends of the rails 34, 36 are fixed to frame end plates 52, 54. Therefore, the rectangular frame comprising side rails 34, 36 and frame end plates 52, 54 is free to slide up and down, relative to mounting plate 50. The vertical motion is controlled by a cam follower 55 mounted on a support 57 attached to upper frame end plate 52. Cam follower 55 rides in a cam track extending along a path accompanying the conveyor which carries the mounting block 50.

A metal support plate 56 is attached at 58 to upper frame plate 52 and at 60, 62 to lower frame plate. A vertical rail 64 is attached to the support plate 56. A sliding bearing member 66 is mounted to slide vertically on rail 64. A bracket member 68 is secured to and movable with bearing member 66. Cam follower wheels 70 are mounted on bracket member 68. Therefore, as the structure of FIG. 5 is mowed along a path defined by a suitable conveyor, a nearby cam track can move wheels 70, and thus bracket member 68 up or down.

The upper ends of a pair of spreader rods 72, 74 are pivotally attached to the bracket member 62 to move up or down in response to the cam track controlled movement. The bottom ends of the spreader rods 72, 74 are pivotally attached to blocks 76, 78. The rods 72, 74 are made similar to a turn buckle so that their lengths may be adjusted by turning a central tube 80.

A horizontal rail 82 is bolted to the bottom of the support plate 56. Two sliding bearings 84, 86 are mounted on horizontal rail 82. Each of the sliding bearings 84, 86 has an individually associated spreader finger 88, 90 attached thereto. The two blocks 76, 78 are bolted to the two sliding bearings 84, 86.

It should now be clear that two separate motions are provided by the structure of FIG. 5 in response to the instantaneous positions of the structure on the conveyor, as those positions are defined by cam tracks accompanying the conveyor. In greater detail, mounting plate 50 is bolted to a link chain conveyor which travels around an endless path. As it travels, cam 55 rides on a cam track adjacent the path. This cam causes the frame comprising end plates 52, 54 and side rails 34, 36 to move vertically and thereby control the first motion.

The second motion is provided by mounting bracket 66 which also moves vertically under the control of cam follower 70 riding on a cam track adjacent the conveyor path. As the cam follower 70 and mounting bracket 68 move up and away from the horizontal rail 82, the lower ends of the two spreader rods 72, 74 move together pulling blocks 76, 78, and therefore spreader fingers 88, 90, toward the center of horizontal track 82. As the cam follower 70 and mounting bracket 68 move down and toward horizontal rail 82, the lower ends of the spreader rods, and therefore spreader fingers 88, 90, move apart and toward the opposite ends of horizontal rail 82.

Figure 6:
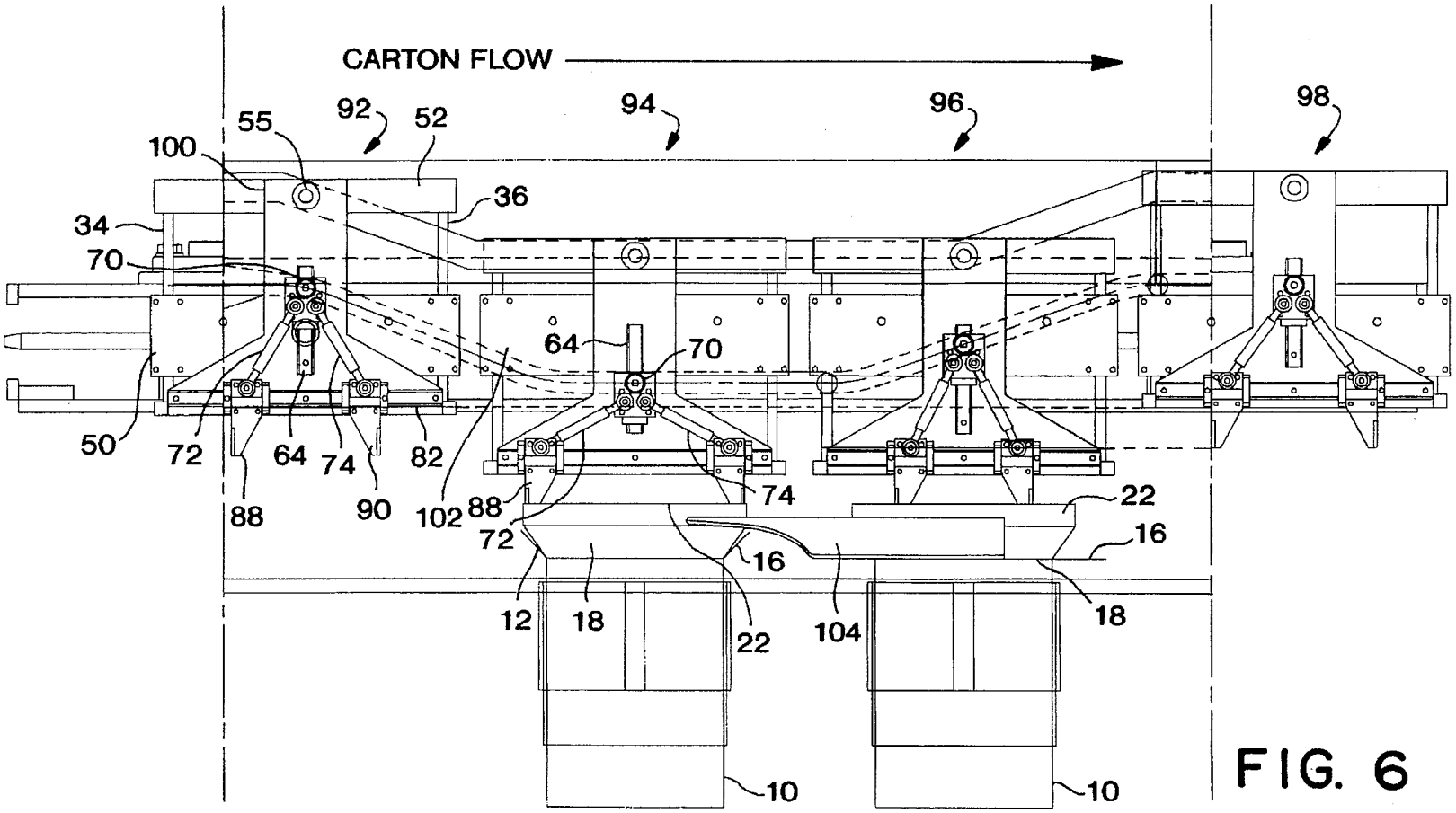
FIG. 6 is a side elevation which shows a module of an automatic packing machine using the spreader of FIG. 5 to close the top of the "bag" formed by the paper end liner.
Figure 8:
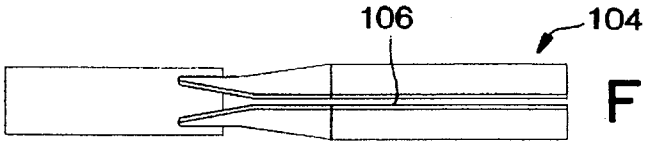
FIG. 8 is a top plan view of the plow which lowers the box flaps while the paper end bag liner is being sealed.
Figure 7:
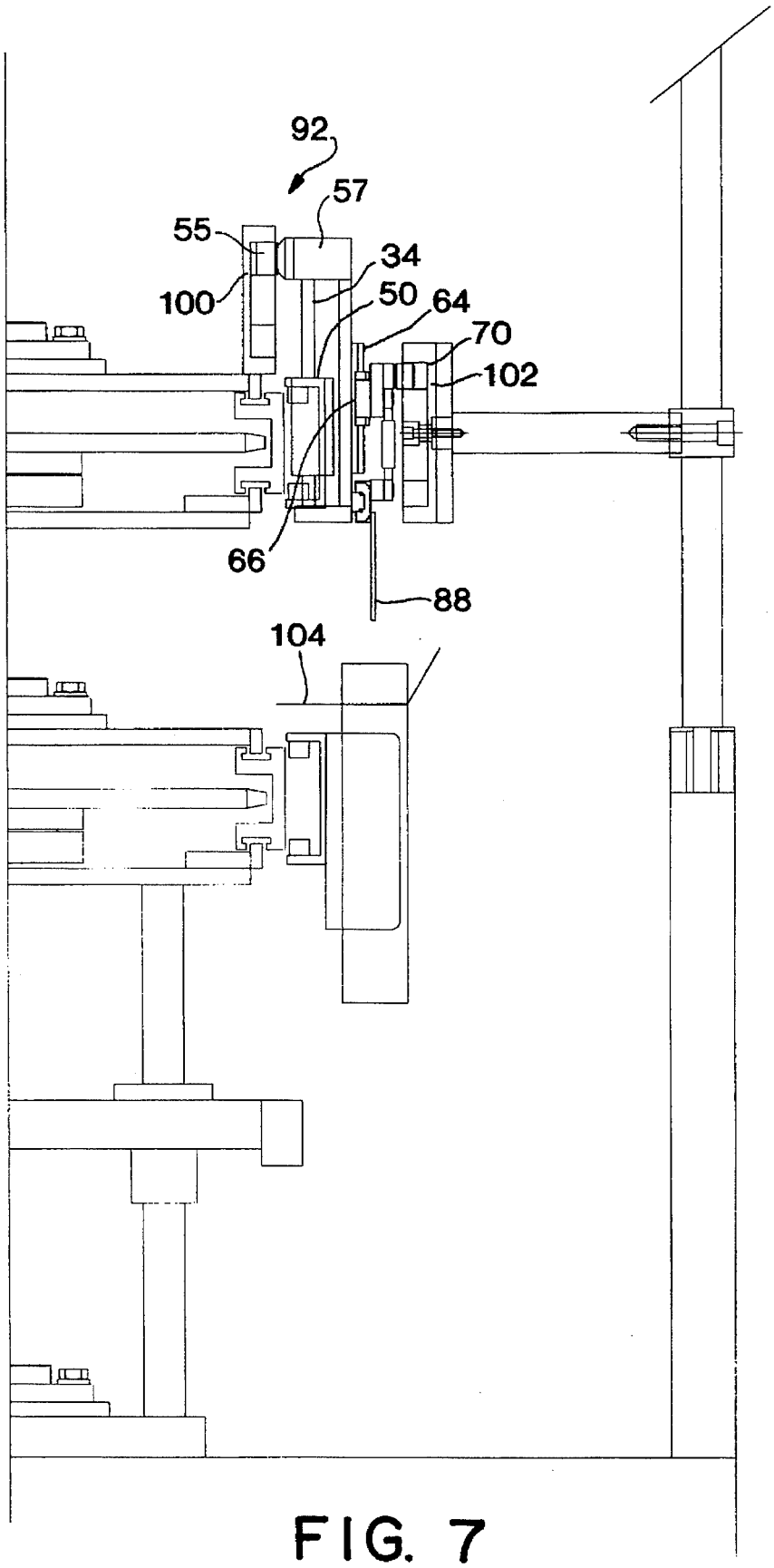
FIG. 7 is an end elevation of the machine of FIG. 6.

FIGS. 6, 7 show the manner in which these two motions are used. In greater detail, at 92–98, respectively, FIG. 6 shows four of the "bag" spreading mechanisms of FIG. 5. In positions 92, 98, the vertical displacement frames 52, 54, 34, 36 are raised for travel along the conveyor. In positions 94, 96, the frames are lowered to engage the paper end liners 22 in boxes. The raised or lowered positions are controlled by cam follower 55 riding in cam track 100. This way the FIG. 5 mechanism is either up and out of the way for travel or down and spreading the paper end liner for sealing the "bag".

The second motion is controlled by a second cam track 102. At positions 92, 94, the cam track 102 raises the cam follower 70 to pull in the lower ends of spreader rods 88, 90 toward the center of horizontal track 82. Therefore, a raised cam follower brings the spreader fingers 88, 90 relatively close together so that when the vertical displacement frame 52, 54, 34, 36 is lowered, the fingers 88, 90 fit into the paper end liner 22.

In positions 96, the cam track lowers the cam follower 70 to spread the lower ends of the spreader rods 72, 74. This pushes the spreader fingers 88, 90 outwardly toward the ends of horizontal track 82 in order to spread the paper end liner 22, thereby bringing the two sides of the "bag" together in a face-to-face confrontation. Then the cam follower 70 is raised to bring the spreader fingers 88, 90 together by the time that they reach position 98. There, the vertical displacement frame withdraws the fingers from the "bag".

Figure 9A:
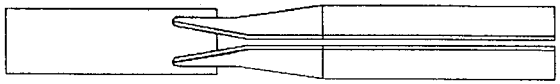
FIG. 9A shows the plow which is similar to that of FIG. 8, but for the bottom of the box and "bag"
Figure 9:
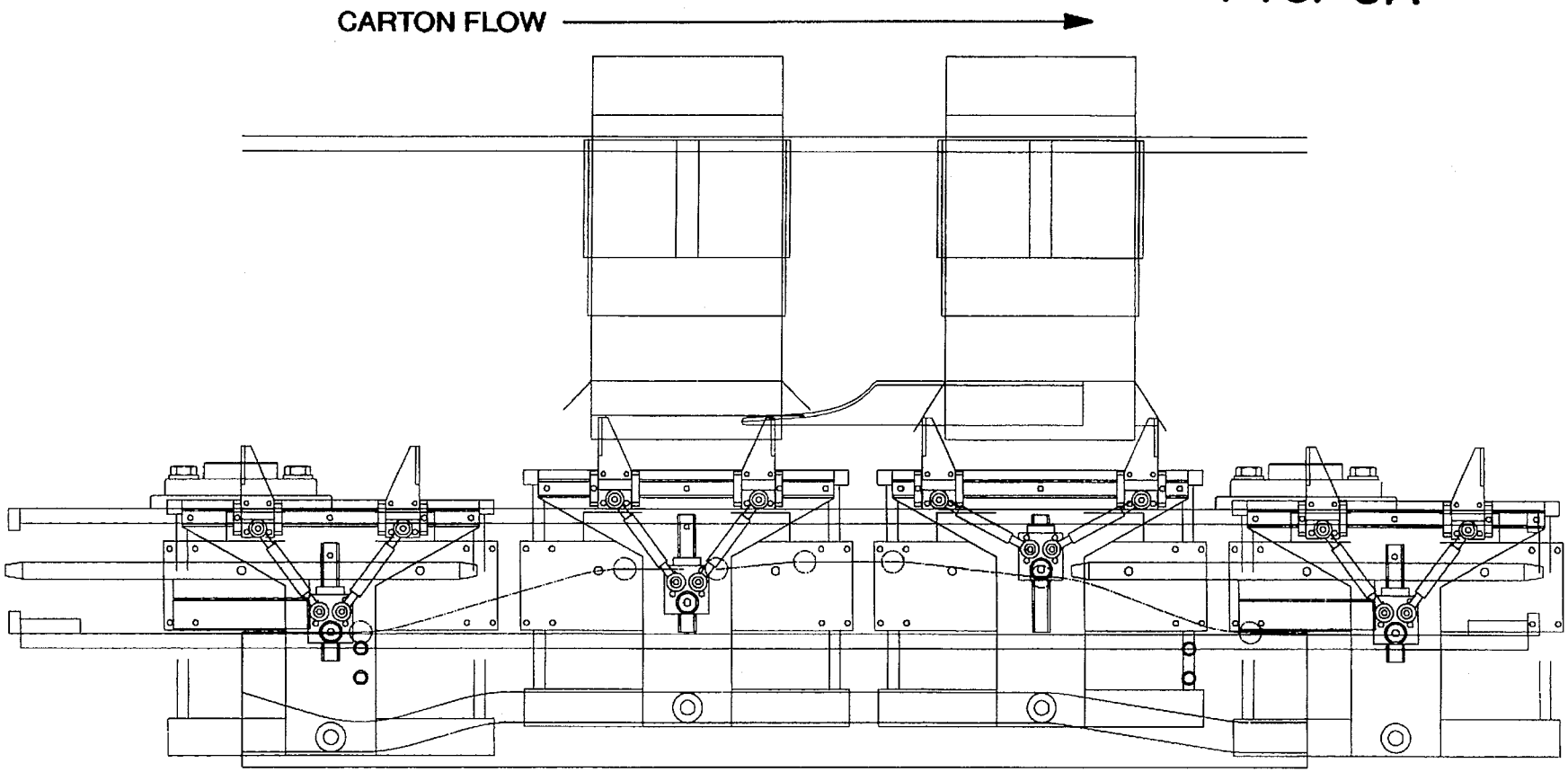
FIG. 9 is a side elevation similar to FIG. 6 except that it shows the module for closing the bottom of the "bag" formed by a paper end liner.
Figure 10:
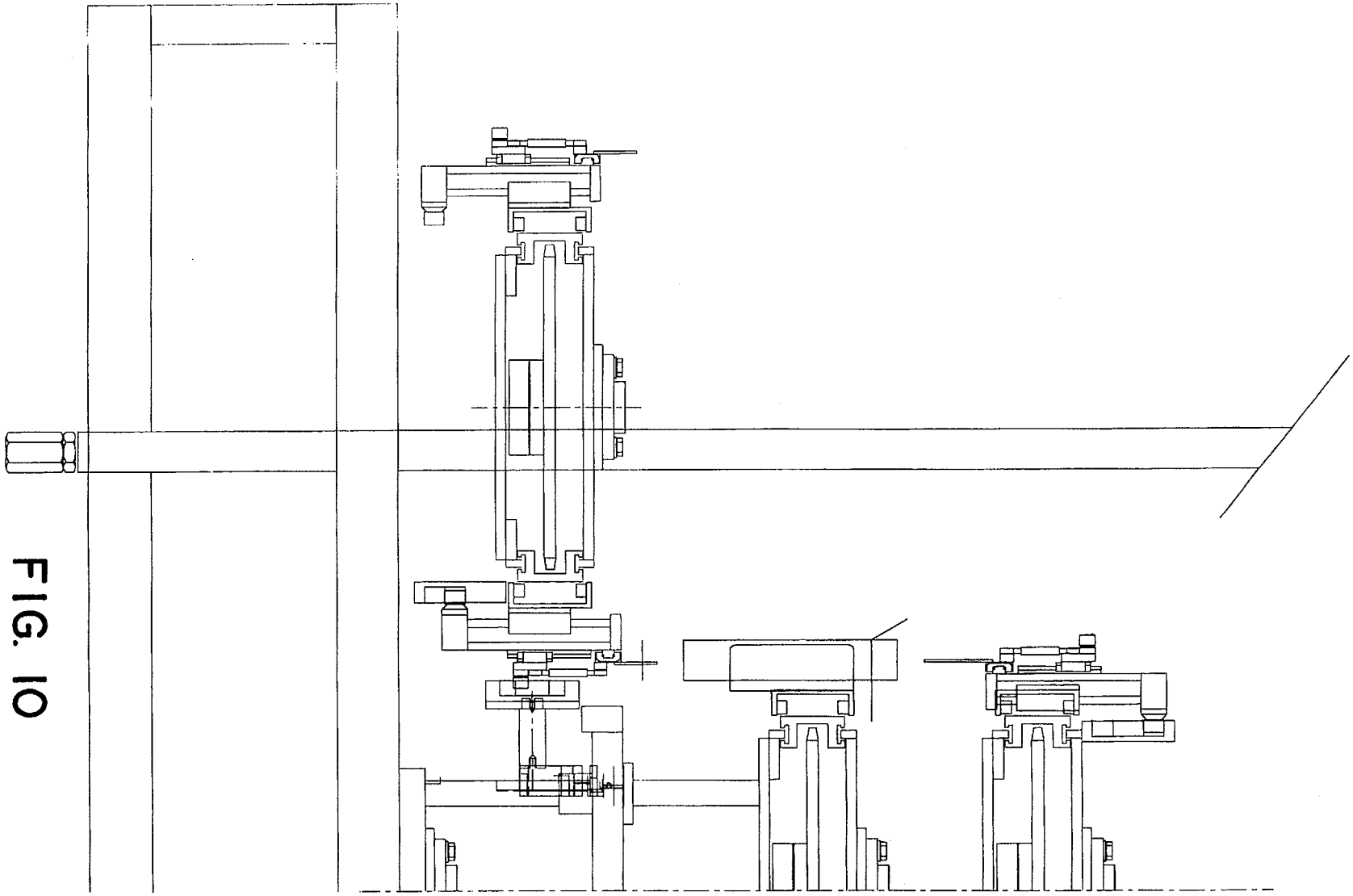
FIG. 10 is a side view of FIG. 9.
Figure 11:
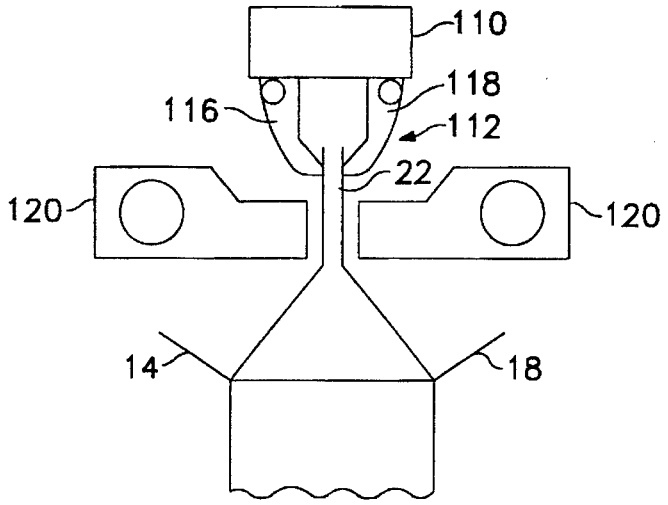
FIG. 11 is an end elevation which shows a detail of a set of pincer fingers which hold the "bag" formed by the paper end liner while it is being heat sealed.

FIGS. 9, 10 are substantially the same as FIGS. 6, 7 except that they are inverted for sealing the "bag" on the bottom of the box. All of the motions are the same in these four figures except that one is moving from the top down while the other is moving from the bottom up.

FIGS. 6, 8, 11 and 12 show the box flap control and the heat sealing equipment. As the box 10 moves from position 94 to position 96, it encounters a plow 104 which is seen in plan view in FIG. 8 (FIG. 9A for the bottom of the box).

The left hand end of plow 104 (as viewed in FIG. 6), rides over the box flaps 12–18, pressing them downwardly and out of the way. The paper end liner 22 passes through a slot 106 which brings the sides of the "bag" together in a face-to-face confrontation.

Means are provided for stretching the "bag" top during heat sealing in order to prevent puckers or pleats which could leak air in the heat sealed edge. More particularly, a conveyor 110 (FIGS. 11, 12) transports two pair of fingers 112, 114. Each of these fingers has two pincer members 116, 118 which pinch the top edge 22 of the "bag" near the ends 26, 28, which were formed by spreading the fingers 88, 90. The pinch is high enough on the edge 22 of the "bag" to pass above one or more heating elements 120 which activate a heat sensitive adhesion on the "bag". After the adhesive is activated, rollers (not shown) squeeze the hot edges together to form the well-known seal formed on bags of potato chips, cereal, and the like.

Figure 12:
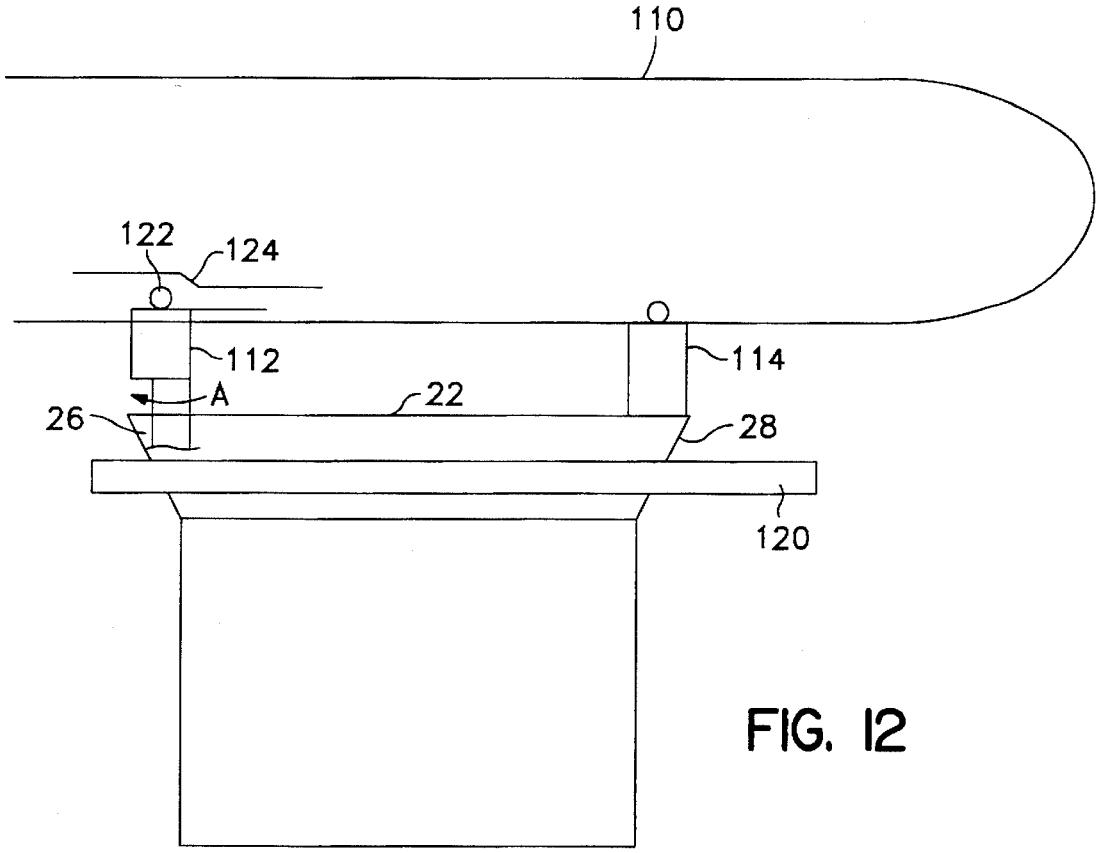
FIG. 12 is a side elevation which shows the fingers of FIG. 11 for holding and spreading the end of the "bag" during the heat sealing.

It is important that the sides of the "bags" be in a smooth, and flush confrontation at the time of sealing, with no pucker, pleat, or the like, which could leave an air hole that might lead to a contamination of the product. In order to assure such a smooth fitting seal, the trailing one of the fingers 112, 114 is pivot mounted to have some limited degree of freedom to swing outwardly, as shown by arrow A (FIG. 12).

As the cam followers follow a cam track, the trailing follower 122 encounters a slight constriction at 124 which causes a friction that creates enough of a drag for causing fingers 112 to move in direction A, thereby stretching the paper end liner 22 between the two pairs of fingers 112, 114. After the heat seal is completed, the finger swings opposite to the direction A, thus returning to normal.

As the seam is heat sealed, it is rolled between two rollers (not shown) mounted on horizontal axes. The rollers leave a somewhat corrugated surface on the heat seal. Photocells (not shown) may monitor light reflected from these corrugations in order to verify the integrity of the seal.

Figure 13:
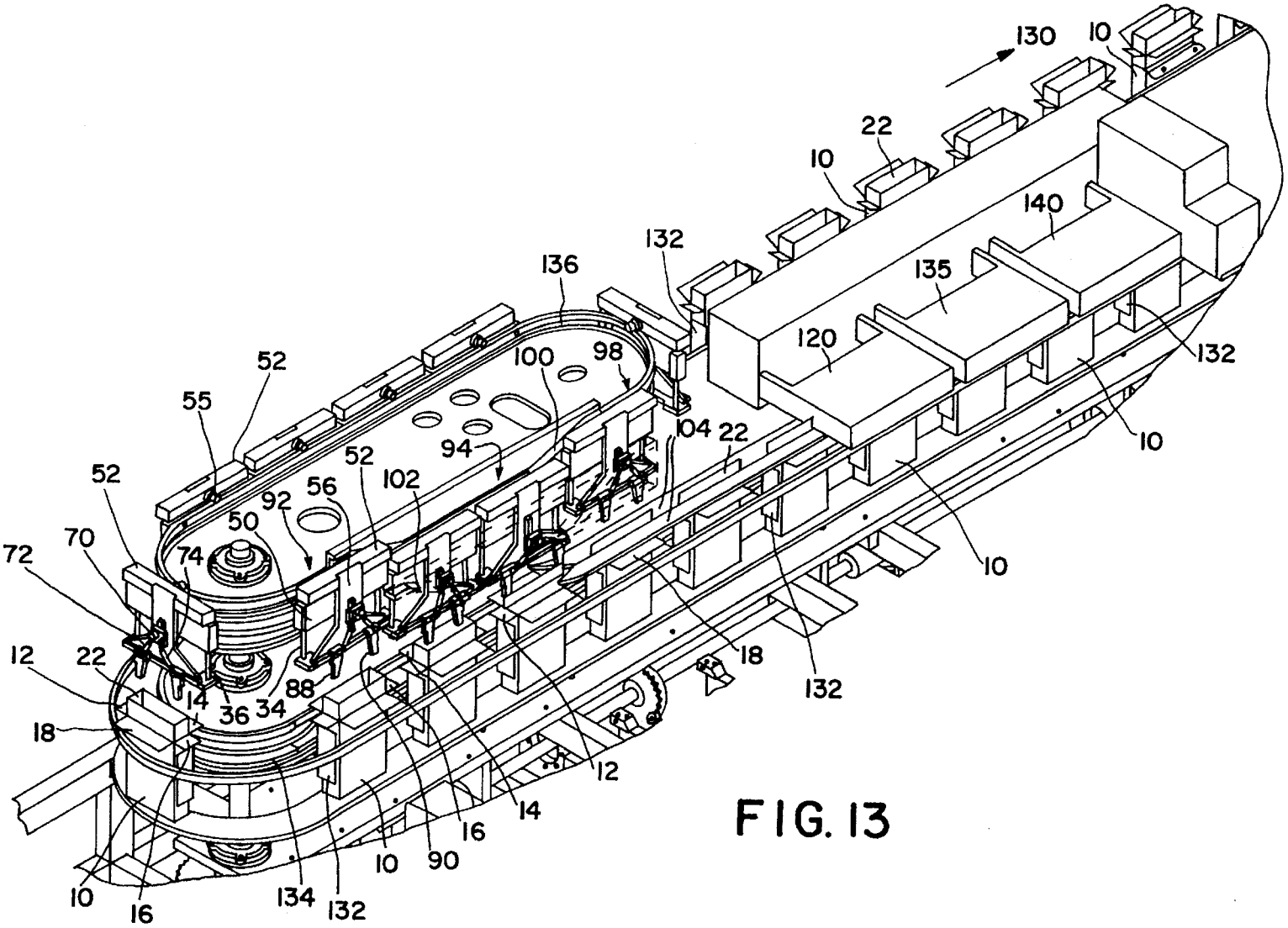
FIG. 13 is a perspective view of an automatic packaging machine incorporating the features of FIGS. 1–12.

FIG. 13 shows a portion of an automatic packaging machine incorporating the features of the invention shown in the remainder of the FIGS. 1–11. The boxes 10 are carried from a point upstream 130 (not shown) where blanks of boxes already containing the narrow paper end strips 22 are picked up, erected, and placed in mandrels 132 on a lower conveyor 134. The boxes 10 are carried past an upper conveyor 136 which carries the "bag" spreading mechanism of FIG. 5. At the positions 92–98, the spreading fingers 88, 90 are lowered into the "bag" top 22 opening where the "bag" top is spread.

Figure 2:
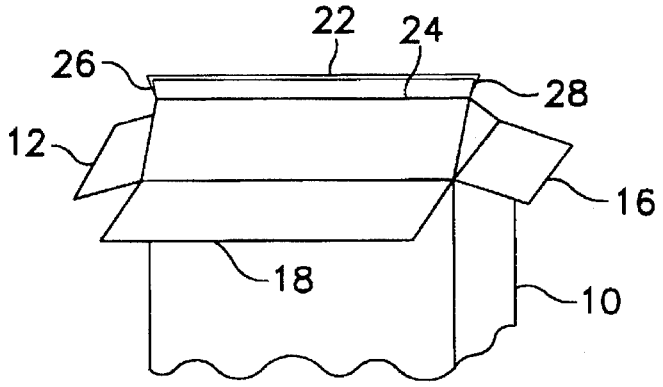
FIG. 2 shows the box end of FIG. 1 after the paper end liner has been sealed.
Figure 3:
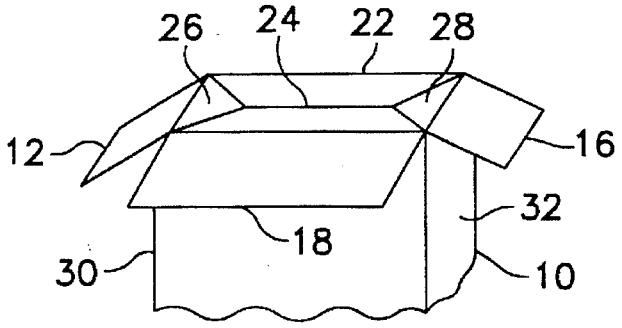
FIG. 3 shows the sealed end liner folded over preparatory to a closing of the box.
Figure 4:
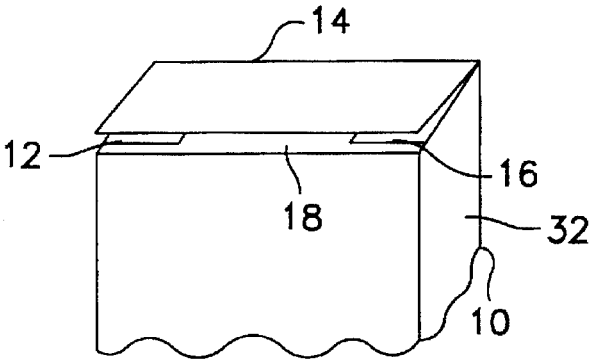
FIG. 4 shows the end flaps of the box sealed over the sealed end of the "bag" formed by the sealed end liner.

The spreading "bag" top 22 passes between plows 104 which hold the now spread "bag" top 22 in an upright position while holding the box flaps 12–18 in a lower or retracted position. The upright "bag" top 22 passes into a work station 120 which performs the functions of FIGS. 11–12. In work stations 138, 140, the box flaps 12–18 are closed and sealed over the sealed "bag" end, as illustrated in FIGS. 2–4. After the boxes are sealed, any suitable packaging machine steps may be performed, such as testing for the integrity of the seal, weighing the closed box, discharge from the machine or the like.

The oval line surrounding FIG. 13 indicates that normal automatic packaging machine functions may also be provided. These functions may include any known steps such as measuring product, filing boxes, etc. or providing support, motors, loaders, controls (including programmed microprocessors, program software, etc.), output conveyors, and the like.

Those who are skilled in the art will readily perceive how to modify the invention. Therefore, the appended claims are to be construed to cover all equivalent structures which fall within the true scope and spirit of the invention.

What is claimed is:

1. An automatic packaging system comprising a first continuously non-stop moving conveyor, a box having end flaps, said box being carried by said first continuously non-stop moving conveyor, a narrow strip secured to and in at least one end of said box, said narrow strip having two spaced parallel edges, one of said edges being sealed to and around an entire inside perimeter of said box and near said at least one end of said box, the other of said two edges being a projecting edge of said narrow strip extending out of said box approximately as far as outer edges of said end flaps when they are extended in line with sides of said box thereby forming a somewhat "bag-like" opening in said box, a second continuously non-stop moving conveyor carrying a pair of spreading fingers moving in synchronism with boxes as they are being carried while said first conveyor is continuously moving, means for moving said spreading fingers toward and away from said boxes whereby said spreading fingers may be inserted into or removed from said somewhat "bag-like" opening formed by said narrow strip sealed to the inside perimeter of said box, means for moving said spreading fingers together for insertion into said somewhat "bag-like" opening and for moving them apart for closing said projecting edges of said narrow strip when said spreading fingers are inserted into said boxes, said closed projecting edge being held in an upstanding position by said spreading fingers, and means for sealing said projecting edges in a single step while said fingers are holding said spread and closed edge in said position in order to close said somewhat "bag-like" opening whereby said narrow strip forms a sealed somewhat bag-like cuff for said box without requiring a full bag that fills the entire box.

2. The system of claim 1 wherein said means for moving said spreading fingers toward and away from said box comprising a frame mounted for vertical movement, a cam follower mounted on said frame, and a cam track adjacent said second conveyor for moving said frame to insert and remove said fingers at preselected locations along a path followed by said second conveyor.

3. The system of claim 2 and a vertical track carried by said frame, a horizontal track carried by said frame for supporting said spreading fingers, a mounting bracket movably carried on said vertical track, a pair of spreading rods having one end pivotally mounted on said mounting bracket, an opposite end of said spreading rods being pivotally connected to individually associated ones of said spreading fingers whereby said spreading fingers move together or apart on said horizontal track responsive to said mounting bracket moving up or down on said vertical track.

4. The system of claim 3 and two pair of pincer fingers for gripping the closed projecting edge of said paper end liner, means for moving one of said pair of pincer fingers away from the other pair of pincer fingers for stretching said gripped edge, and means for applying said heat while said edge is stretched. bracket for controlling said spreader fingers in response to a cam track accompany said conveyor.

5. The system of claim 1 wherein said means for sealing said projecting edges comprises a pair of pincer means for gripping opposite ends of said narrow strip after sides of said strip are spread by said spreading fingers, a heating element, a continuously moving conveyor means for carrying said pair of pincers means past said heating element while said sides of said strip are being gripped in a face-to-face confrontation, one of said pincer means trailing the other of said pincer means on said conveyor means, means for pivot mounting at least the trailing one of said pincer means for swing in line with and away from the other of said pincer means thereby stretching said sides into a tighter face-to-face confrontation, and means for swinging said pivot mounted means in response to a sensing of an instantaneous position of said device on said conveyor means.

6. A device for sealing a "bag-like" cuff end in a hybrid combination of a box with end flaps having a narrow paper-like end strip sealed around an entire interior perimeter of said box, said device comprising a pair of pincer means for gripping opposite ends of said narrow paper-like end strip while opposite sides of said strip are in a face-to-face confrontation, a heating element, first continuously moving non-stop conveyor means for carrying said hybrid box around a first closed loop, second continuously moving non-stop conveyor means for carrying said pair of pincers means around a second closed loop in synchronism with said hybrid box, said first and second continuously moving non-stop conveyor means carrying said hybrid box past said heating element while said opposite sides are being held upright in said face-to-face confrontation by said pincer means, means for pivot mounting at least one of said pincer means to swing in line with and away from the other of said pincer means thereby stretching said opposite sides into a tighter face-to-face confrontation while passing said heating element, and means for swinging said pivoted pincer means to stretch said opposite sides in response to said pivot mounting means reaching a predetermined location on said second closed loop and adjacent said heating element.

7. The device of claim 6 and plow means for displacing and holding said end flaps away from said pincers and said heating element.

8. The device of claim 7 wherein a position of said pivoted pincers means is controlled by an associated cam follower riding on a cam track accompanying said conveyor, and said means for swinging said pivoted means is a constriction in said cam track to create a drag upon said associated cam follower.

9. The device of claim 8 wherein said pincer means grip an outer edge of said opposite sides while in said face-to-face confrontation, said plow means is remote from said gripped edges, and said heating element is between said gripped edges and said plow means.

10. The device of claim 6 further comprising a first conveyor, a plow means for retracting said end flaps, said box being carried past said plow means, a projecting edge of said narrow paper end strip extending out of said box approximately as far as said end flaps extend, said narrow strip being exposed for sealing while said end flaps are retracted, means for moving a pair of spreading fingers in synchronism with said carried boxes, means for moving said spreading fingers toward and away from said boxes whereby said spreading fingers may be inserted into or removed from a "bag" opening formed by said narrow paper end strip sealed to the inside perimeter of said box, means for moving said spreading fingers together for insertion into said "bag" opening and apart for closing said projecting edges of said narrow paper end strip when said spreading fingers are inserted into said boxes, and means for presenting said edges closed by said spreading means to said pincer means for sealing said projecting edges of said paper end strip.

11. A device for sealing a "bag-like" cuff end in a hybrid combination of a box with end flaps having a narrow paper-like end strip having one side sealed around an entire interior perimeter of said box and an opposite side projecting out of said box to provide a bag-like opening, said device comprising a pair of means for spreading opposite ends of said narrow paper-like end strip so that said opposite sides of said strip are in a face-to-face confrontation for closing said bag-like opening, a heating element, first continuously moving non-stop conveyor means for carrying said hybrid box around a first closed loop, second continuously moving non-stop conveyor means for carrying said pair of spreading means around a second closed loop in synchronism with said hybrid box, said first and second continuously moving non-stop conveyor means carrying said hybrid box past said heating element while said opposite sides are being held upright in said face-to-face confrontation by said spreading means, means for pivot mounting at least one of said spreading means to swing in line with and away from the other of said spreading means for stretching said opposite sides into a tighter face-to-face confrontation while passing said heating element, means for swinging said pivoted spreading means to stretch said opposite sides of said paper-like strip in response to said pivot mounting means reaching a predetermined location on said second closed loop and adjacent said heating element; a cam track accompanying said conveyor, said cam track having a constriction therein, said instanteous position of said pivoted spreading means being controlled by an associated cam follower riding on said cam track accompanying said conveyor, and said means for swinging said pivoted spreader means is said constriction in said cam track creating a drag upon said associated cam follower.

* * * * *